US011610750B2

(12) United States Patent
Lee et al.

(10) Patent No.: US 11,610,750 B2
(45) Date of Patent: Mar. 21, 2023

(54) ELECTROMECHANICAL SWITCH WITH STABILIZED ENGAGEMENT BETWEEN CONTACTS

(71) Applicant: TE CONNECTIVITY CORPORATION, Berwyn, PA (US)

(72) Inventors: Albert Yong Lee, Greensboro, NC (US); Roger Lee Thrush, Clemmons, NC (US)

(73) Assignee: TE Connectivity Solutions GmbH

( * ) Notice: Subject to any disclaimer, the term of this patent is extended or adjusted under 35 U.S.C. 154(b) by 735 days.

(21) Appl. No.: 16/100,559

(22) Filed: Aug. 10, 2018

(65) Prior Publication Data

US 2020/0051766 A1 Feb. 13, 2020

(51) Int. Cl.

| | |
|---|---|
| ***H01H 50/58*** | (2006.01) |
| ***H01H 1/06*** | (2006.01) |
| ***H01H 1/20*** | (2006.01) |
| ***H01H 50/36*** | (2006.01) |
| ***H01H 50/54*** | (2006.01) |
| *H01H 50/30* | (2006.01) |

(52) U.S. Cl.

CPC ..... *H01H 50/58* (2013.01); *H01H 1/06* (2013.01); *H01H 1/2016* (2013.01); *H01H 1/2075* (2013.01); *H01H 50/36* (2013.01); *H01H 50/546* (2013.01); *H01H 50/305* (2013.01); *H01H 2235/01* (2013.01)

(58) Field of Classification Search

CPC ..... H01H 50/58; H01H 1/06
USPC ..... 335/126, 133, 196
See application file for complete search history.

(56) References Cited

U.S. PATENT DOCUMENTS

| | | | | |
|---|---|---|---|---|
| 2,254,729 A * | 9/1941 | Bryant | H01H 23/164 200/277.2 |
| 3,024,334 A | 3/1962 | Rhodes | |
| 3,316,513 A * | 4/1967 | Bradford | H01H 51/287 335/154 |
| 3,790,732 A | 2/1974 | Slamecka et al. | |
| 4,224,489 A * | 9/1980 | Dietrich | H01H 1/2083 200/16 A |

(Continued)

FOREIGN PATENT DOCUMENTS

| | | |
|---|---|---|
| GB | 1011852 | 12/1965 |
| JP | 2012199117 A | 10/2012 |

OTHER PUBLICATIONS

International Search Report, International Application No. PCTIB2019/056654, International Filing Date, Aug. 5, 2019.

(Continued)

*Primary Examiner* — Alexander Talpalatski

(57) ABSTRACT

An electromechanical switch includes first and second stationary contacts and a movable contact. Each of the first and second stationary contacts has a respective protrusion at a mating end thereof. The movable contact defines a first depression and a second depression along a mating side thereof. The movable contact is reciprocally movable into and out of a closed position relative to the first and second stationary contacts. In the closed position, the mating side of the movable contact engages the mating ends of the first and second stationary contacts such that the protrusion of the first stationary contact projects into the first depression and the protrusion of the second stationary contact projects into the second depression.

5 Claims, 7 Drawing Sheets

(56) References Cited

U.S. PATENT DOCUMENTS

| | | | | |
|---|---|---|---|---|
| 5,424,700 | A * | 6/1995 | Santarelli | H01H 1/06 335/126 |
| 5,548,260 | A * | 8/1996 | Kogure | H01H 1/06 335/126 |
| 9,543,679 | B2 * | 1/2017 | Schmidt | H01R 13/2485 |
| 10,153,116 | B2 * | 12/2018 | Sprague | H01H 1/06 |
| 2012/0152713 | A1 * | 6/2012 | Orricio | H01H 5/30 200/447 |
| 2015/0303016 | A1 | 10/2015 | Sprague et al. | |
| 2019/0019645 | A1 * | 1/2019 | Lee | H01H 50/60 |

OTHER PUBLICATIONS

Japanese Office Action, Application No. 2021-507035, dated Apr. 5, 2022.

* cited by examiner

ELECTROMECHANICAL SWITCH WITH STABILIZED ENGAGEMENT BETWEEN CONTACTS

BACKGROUND OF THE INVENTION

The subject matter herein relates generally to electromechanical switches (e.g., contactors or relays) that control a flow of electrical power through a circuit.

Electromechanical switches may be used in a number of applications in which it is desirable to selectively control the flow of electrical power (e.g., current). Electromechanical switches, such as contactors or relays, may include a movable contact and a plurality of stationary contacts. The movable contact is selectively moved to engage or disengage the stationary contacts. When the movable contact is engaged to the stationary contacts, a closed circuit is formed and electrical current can flow through the stationary contacts across the movable contact. When the movable contact is spaced apart from at least one of the stationary contacts, the circuit is open preventing the flow of current through the contacts.

In certain applications, an audible noise is generated along the interfaces between the movable contact and the stationary contacts. For example, a surge of current through the contacts may cause repulsive forces at the engagement interfaces between the contacts. The repulsive forces cause the movable contact to oscillate and vibrate, generating an audible noise. The audible noise can be distracting and/or annoying to individuals nearby. The oscillations of the movable contact may also degrade the engagement surfaces of the movable contact and/or the stationary contacts, reducing the operational lifetimes of these components.

Accordingly, a need remains for an electromechanical switch that prevents or at least reduces oscillations of the contacts during surges of current.

BRIEF DESCRIPTION OF THE INVENTION

In one or more embodiments, an electromechanical switch is provided that includes first and second stationary contacts and a movable contact. The first and second stationary contacts are spaced apart from each other. Each of the first and second stationary contacts has a respective protrusion at a mating end thereof. The movable contact has a mating side and defines a first depression and a second depression along the mating side. The first and second depressions are spaced apart from each other along a length of the movable contact. The movable contact is reciprocally movable into and out of a closed position relative to the first and second stationary contacts. In the closed position, the mating side of the movable contact engages the mating ends of the first and second stationary contacts such that the protrusion of the first stationary contact projects into the first depression and the protrusion of the second stationary contact projects into the second depression.

In one or more embodiments, an electromechanical switch is provided that includes first and second stationary contacts, a movable contact, and an armature assembly. The first and second stationary contacts are spaced apart from each other, and each of the first and second stationary contacts has a respective protrusion at a mating end thereof. The movable contact has a mating side and defines a first depression and a second depression along the mating side. Each of the first and second depressions inwardly extends from a respective edge at the mating side. The armature assembly includes a shaft coupled to the movable contact and a ferromagnetic plunger coupled to the shaft. The armature assembly reciprocally moves the movable contact into and out of a closed position relative to the first and second stationary contacts based on a magnetic field induced by current through a coil of wire surrounding the ferromagnetic plunger. In the closed position, the protrusion of the first stationary contact projects into the first depression and engages the edge of the first depression at multiple contact points, and the protrusion of the second stationary contact projects into the second depression and engages the edge of the second depression at multiple contact points.

In one or more embodiments, an electromechanical switch is provided that includes first and second stationary contacts and a movable contact. The first and second stationary contacts are spaced apart from each other, and each of the first and second stationary contacts has a respective depression along a mating end thereof. The mating ends of the first and second stationary contacts define edges of the depressions. The movable contact has a mating side that includes a planar surface and first and second protrusions that project beyond the planar surface towards the first and second stationary contacts. The first and second protrusions are spaced apart from each other along a length of the movable contact. The movable contact is reciprocally movable into and out of a closed position relative to the first and second stationary contacts. In the closed position, the first protrusion of the movable contact projects into the depression of the first stationary contact and engages the edge thereof at multiple contact points, and the second protrusion of the movable contact projects into the depression of the second stationary contact and engages the edge thereof at multiple contact points.

DETAILED DESCRIPTION OF THE INVENTION

Embodiments of the present disclosure provide an electromechanical switch, such as a relay or contactor, that is configured to selectively establish and break an electrical circuit between a power source and an electrical load. The electromechanical switch may be configured to convey high electric current rates, such as 1000 Amperes (A) or greater. The electromechanical switch according to the embodiments described herein stabilizes the engagement between the movable contact and stationary contacts when the switch is in the closed, conducting position, which eliminates or at least diminishes oscillation and vibration at the engagement interfaces even when exposed to high current surges across the contacts. The electromechanical switch described herein may eradicate the generation of a distracting and/or annoying audible noise that occurs due to oscillations and vibrations between the contacts of known electromechanical switches during surges of current (e.g., high slew rates) through the contacts.

Figure 1:
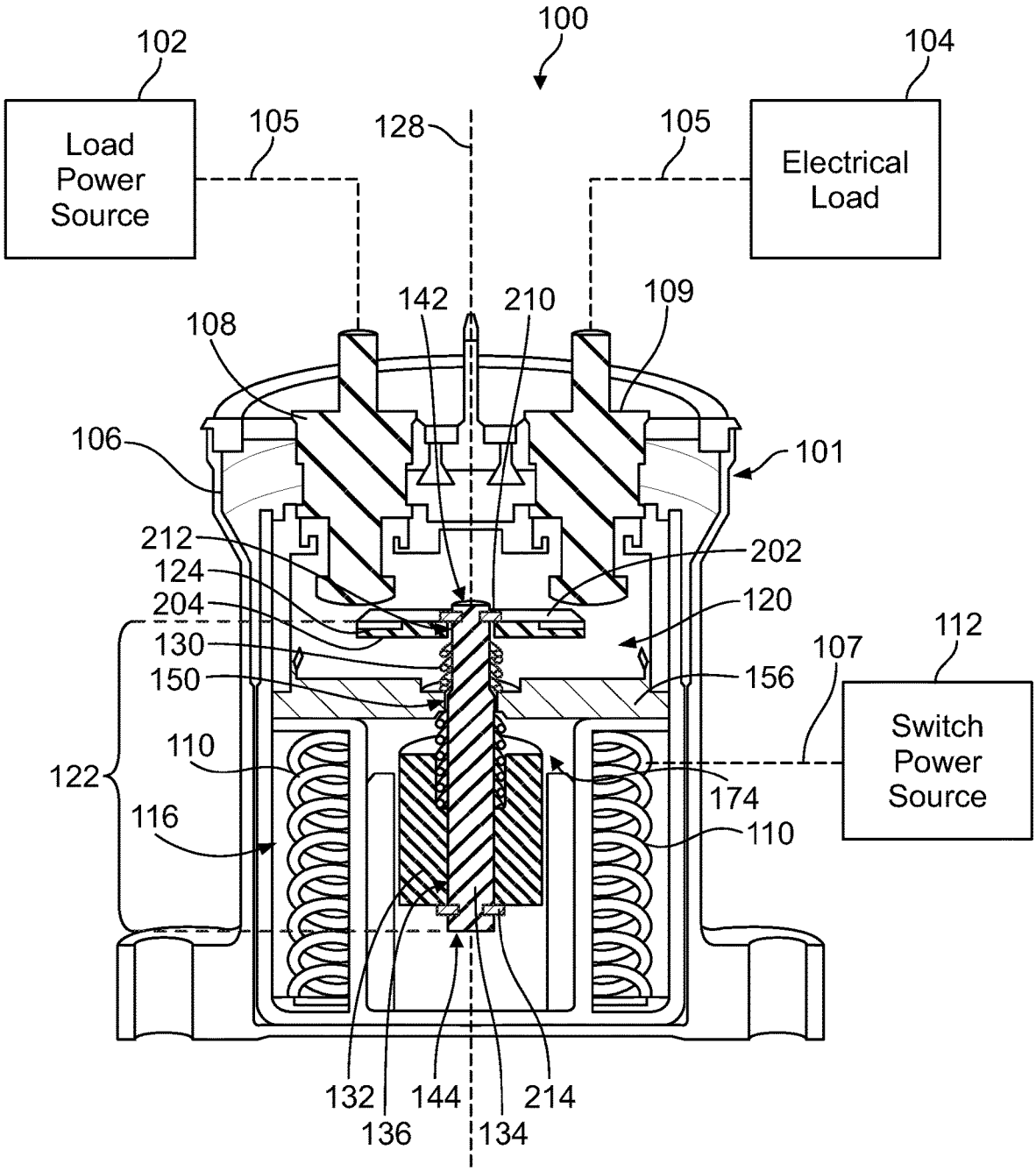
FIG. 1 is a schematic diagram of a power circuit formed in accordance with an embodiment showing a cross-sectional view of an electromechanical switch of the power circuit in an open state.

FIG. 1 is a schematic diagram of a power circuit 100 formed in accordance with an embodiment showing a cross-sectional view of an electromechanical switch 101 of the power circuit 100 in an open state. The power circuit 100 has several components including the electromechanical switch 101, a load power source 102, an electrical load 104, and a switch power source 112, as well as electrically conductive elements 105, such as wires, traces, and the like, interconnecting the components.

The electromechanical switch 101 is an electrically operated switch is used to selectively control the presence or absence of current flowing through the power circuit 100 between the load power source 102 and the electrical load 104. The electromechanical switch 101 closes (or establishes) a circuit to allow current to flow through the power circuit 100 from the load power source 102 to the electrical load 104 to power the load 104. The electromechanical switch 101 opens (or breaks) the circuit to stop the flow of current through the power circuit 100 to the electrical load 104. The electromechanical switch 101 may be a relay device or a contactor device.

In one non-limiting example application, the power circuit 100 may be installed within a vehicle, such as a hybrid or fully electric automobile. The load power source 102 may represent or include a battery, such as a traction battery used to power propulsion of the vehicle. The electrical load 104 may represent or include a motor, a heating and/or cooling system, a lighting system, a vehicle electronics system, or the like. For example, the electromechanical switch 101 may be disposed along a conductive pathway between the traction battery and a traction motor that is utilized for generating torque to rotate the wheels and propel the vehicle. When a driver of the vehicle presses the accelerator pedal, the contacts of the electromechanical switch 101 may engage one another to close (e.g., form) the conductive pathway and enable the battery to supply current to the traction motor to accelerate the vehicle. The electromechanical switch 101 may also be used to convey electrical current in the reverse direction from the electrical load 104 to the load power source 102 for charging the load power source 102, such as during regenerative braking of the vehicle. Alternatively, the power circuit 100 may be utilized in other applications, such as in industrial machinery or in vehicles other that automobiles, such as off-highway vehicles, rail vehicles and/or marine vessels.

The electromechanical switch 101 includes first and second stationary contacts 108, 109 and a movable contact 124. The first stationary contact 108 is spaced apart from the second stationary contact 109. The first stationary contact 108 is electrically connected to the load power source 102, and the second stationary contact 109 is electrically connected to the electrical load 104. The electromechanical switch 101 may also include a housing 106. The first and second stationary contacts 108, 109 are mounted to the housing 106 and secured in fixed positions relative to the housing 106.

The movable contact 124 is reciprocally movable relative to the stationary contacts 108, 109 into and out of engagement with the stationary contacts 108, 109. In FIG. 1, the movable contact 124 is in an open position meaning that the movable contact 124 is not engaged with the stationary contacts 108, 109. In the open position, a closed circuit path across the three contacts 108, 109, 124 is not established, and the load power source 102 is disconnected from the electrical load 104. When the electromechanical switch 101 is in a closed position, the movable contact 124 engages both the first and second stationary contacts 108, 109 and a closed circuit path is formed across the three contacts 108, 109, 124, enabling current flow between the power source 102 and the electrical load 104.

In the illustrated embodiment, the electromechanical switch 101 also includes an armature assembly 122. The armature assembly 122 moves reciprocally (e.g., bi-directionally) along an actuation axis 128 relative to the stationary contacts 108, 109. The movable contact 124 is coupled to the armature assembly 122 and moves with the armature assembly 122 relative to the stationary contacts 108, 109. For example, the armature assembly 122 may move the movable contact 124 into and out of engagement with the stationary contacts 108, 109.

In an embodiment, the movement of the armature assembly 122 may be based on a magnetic field induced by current through a wire coil 110. The wire coil 110 is electrically connected, via one or more conductive elements 107, to a switch power source 112 which provides electrical current to the wire coil 110 to induce a magnetic field. The switch power source 112 may be selectively operated to control the magnetic field induced by the wire coil 110. In an example, when the switch power source 112 supplies current to the wire coil 110, an induced magnetic field causes the armature assembly 122, and the movable contact 124 coupled thereto, to move along the actuation axis 128 towards the stationary contacts 108, 109 until the movable contact 124 engages both stationary contacts 108, 109. In response to the switch power source 112 ceasing to supply current or supplying a different current, the armature assembly 122 may axially return towards a starting position due to biasing forces, such as gravity and/or spring forces, which causes the movable contact 124 to disengage and separate from the stationary contacts 108, 109. In FIG. 1, the wire coil 110 is disposed within the housing 106 and surrounds at least a portion of the armature assembly 122.

The armature assembly 122 includes a shaft 134, a ferromagnetic plunger 132, and a contact spring 130. The shaft 134 is coupled to both the ferromagnetic plunger 132 (referred to herein as plunger 132) and the movable contact 124. The shaft 134 is elongated between a first end 142 of the shaft 134 and an opposite, second end 144 of the shaft 134. The first end 142 of the shaft 134 is coupled to the movable contact 124. For example, the first end 142 may extend into an opening 212 in the movable contact 124. The first end 142 of the shaft 134 may be coupled to the movable contact 124 via a clip 210, as shown, or, alternatively, may be threaded onto the movable contact 124 or connected via deflectable latches, adhesives, or other fasteners. The shaft 134 is coupled to the plunger 132 at or proximate to the second end 144. For example, the second end 144 may extend into a channel 136 of the plunger 132 to secure the shaft 134 to the plunger 132 via a clip 214. Alternatively, the shaft 134 may secure to the plunger 132 via an interference fit, one or more deflectable latches, an adhesive, and/or the like. The plunger 132 is fixedly secured to the shaft 134 such that the plunger 132 moves with the shaft 134 along the actuation axis 128 and there is no relative movement between the two components along the actuation axis 128. The movable contact 124 may be movably coupled to the shaft 134 such that the movable contact 124 is able to move axially along to the shaft 134 (e.g., towards and away from the second end 144). The movable contact 124 and the plunger 132 are spaced apart from one another along a length of the shaft 134.

The housing 106 includes a divider wall 156 that is located between the movable contact 124 and the wire coil 110. The housing 106 in the illustrated embodiment is a vessel that defines an interior chamber 174. The divider wall 156 segments the chamber 174 into a contact region 120 and an electromagnetic region 116. The stationary contacts 108, 109 and the movable contact 124 are located within the contact region 120. The stationary contacts 108, 109 project out of the chamber 174 of the housing 106 to electrically connect to the conductive elements 105. The wire coil 110 is disposed within the electromagnetic region 116.

The shaft 134 extends into both the contact region 120 and the electromagnetic region 116. The divider wall 156 defines an aperture 150 therethrough, and the shaft 134 extends through the aperture 150. The movable contact 124 and the plunger 132 are located along opposite sides of the divider wall 156. The movable contact 124 is located within the contact region 120, and the plunger 132 is located within the electromagnetic region 116. The armature assembly 122 moves relative to the divider wall 156 along the actuation axis 128.

The plunger 132 within the electromagnetic region 116 is circumferentially surrounded by the wire coil 110. The plunger 132 includes a ferromagnetic material, such as iron, nickel, cobalt, and/or an alloy containing one or more of iron, nickel, and cobalt. The plunger 132 has magnetic properties that allow the plunger 132 to translate in the presence of the magnetic field induced by the wire coil 110.

The contact spring 130 surrounds the shaft 134. The contact spring 130 is located within the contact region 120 between the movable contact 124 and the divider wall 156. The contact spring 130 is a coil spring in the illustrated embodiment. The contact spring 130 may be compressed between the movable contact 124 and the divider wall 156 to force the movable contact 124 towards the stationary contacts 108, 109. The contact spring 130 directly or indirectly engages a mounting side 204 of the movable contact 124 that faces towards the divider wall 156. The contact spring 130 exerts a biasing force on the movable contact 124 that urges a mating side 202 of the movable contact 124 into sustained engagement with the clip 210. The mating side 202 is opposite the mounting side 204, and faces towards the stationary contacts 108, 109. In the closed position, the mating side 202 of the movable contact 124 engages the stationary contacts 108, 109.

Figure 2:
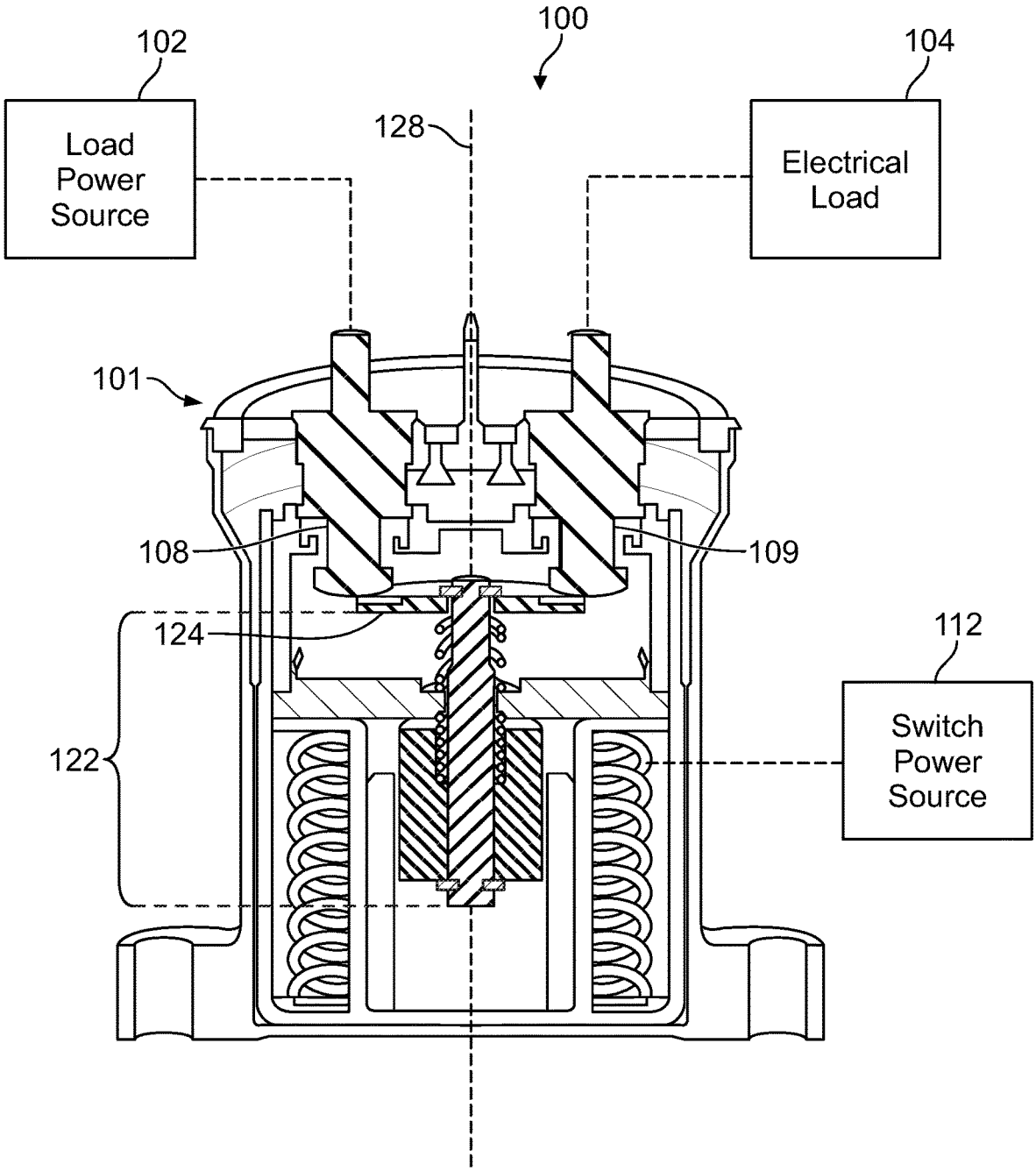
FIG. 2 is a schematic diagram of the power circuit of FIG. 1 with the electromechanical switch in a closed state in which a movable contact engages stationary contacts.

FIG. 2 is a schematic diagram of the power circuit 100 of FIG. 1 with the electromechanical switch 101 in a closed state according to an embodiment. The closed state of the electromechanical switch 101 occurs when the movable contact 124 is in the closed position. In the closed position, the movable contact 124 engages and is conductively connected to both of the stationary contacts 108, 109. The movable contact 124 provides a closed circuit path that bridges the two stationary contacts 108, 109 to allow current flow through all three of the contacts 108, 109, 124. In the illustrated embodiment, when the movable contact 124 is in the closed position, electric current from the load power source 102 is conveyed from the first stationary contact 108 across the movable contact 124 and then the second stationary contact 109 to the electrical load 104 to power the load 104. Although two stationary contacts 108, 109 and one movable contact 124 are shown in FIGS. 1 and 2, it is recognized that the electromechanical switch 101 in other embodiments may have a different number of stationary contacts and/or a different number of movable contacts.

The closed position is achieved by the armature assembly 122 moving from the position shown in FIG. 1 towards the stationary contact 108, 109 along the actuation axis 128. The movable contact 124 may transition from the closed position to the open position shown in FIG. 1 in response to the armature assembly 122 moving away from the stationary contacts 108, 109, which causes the movable contact 124 to separate from and disengage the stationary contacts 108, 109. The disconnection breaks the circuit and stops current flow between the load power source 102 and the electrical load 104.

Figure 3:
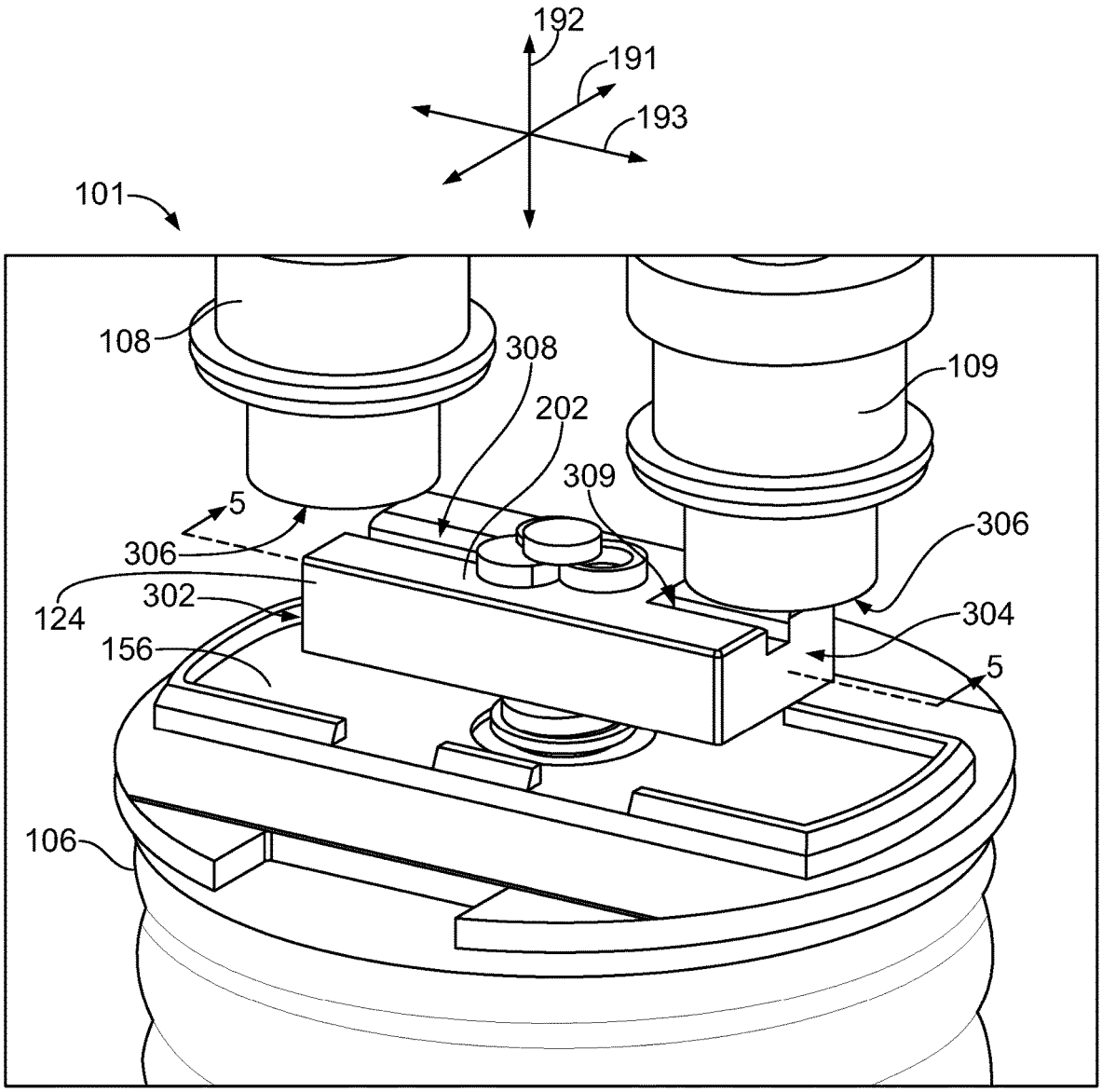
FIG. 3 is a perspective view of a portion of the electromechanical switch according to an embodiment.

FIG. 3 is a perspective view of a portion of the electromechanical switch 101 according to an embodiment. The illustrated portion of the electromechanical switch 101 includes the first and second stationary contacts 108, 109, the movable contact 124, and the divider wall 156 of the housing 106. The electromechanical switch 101 is oriented with respect to a lateral axis 191, a height axis 192, and a longitudinal axis 193. The axes 191-193 are mutually perpendicular. The height axis 192 is parallel to the actuation axis 128 shown in FIGS. 1 and 2. Although the height axis 192 appears to extend in a vertical direction parallel to the force of gravity in FIG. 3, it is understood that the axes 191-193 are not required to have any particular orientation with respect to gravity.

The first and second stationary contacts 108, 109 are spaced apart from each other along the longitudinal axis 193. The movable contact 124 extends a length along the longitudinal axis 193 from a first end 302 of the movable contact 124 to a second end 304 of the movable contact 124. The mating side 202 of the movable contact 124 extends between the first and second ends 302, 304 and faces towards the stationary contacts 108, 109. Each of the stationary contacts 108, 109 has a respective mating end 306 that faces towards the movable contact 124. The movable contact 124 is in an open position and separated from the stationary contacts 108, 109 in FIG. 3, but when in the closed position, the mating ends 306 of the stationary contacts 108, 109 engage the mating side 202 of the movable contact 124 to establish the conductive circuit path.

The movable contact 124 defines a first depression 308 and a second depression 309 along the mating side 202. The first depression 308 is spaced apart from the second depression 309 along the longitudinal length of the movable contact 124. The first depression 308 aligns with the first stationary contact 108, and the second depression 309 aligns with the second stationary contact 109.

Figure 4:
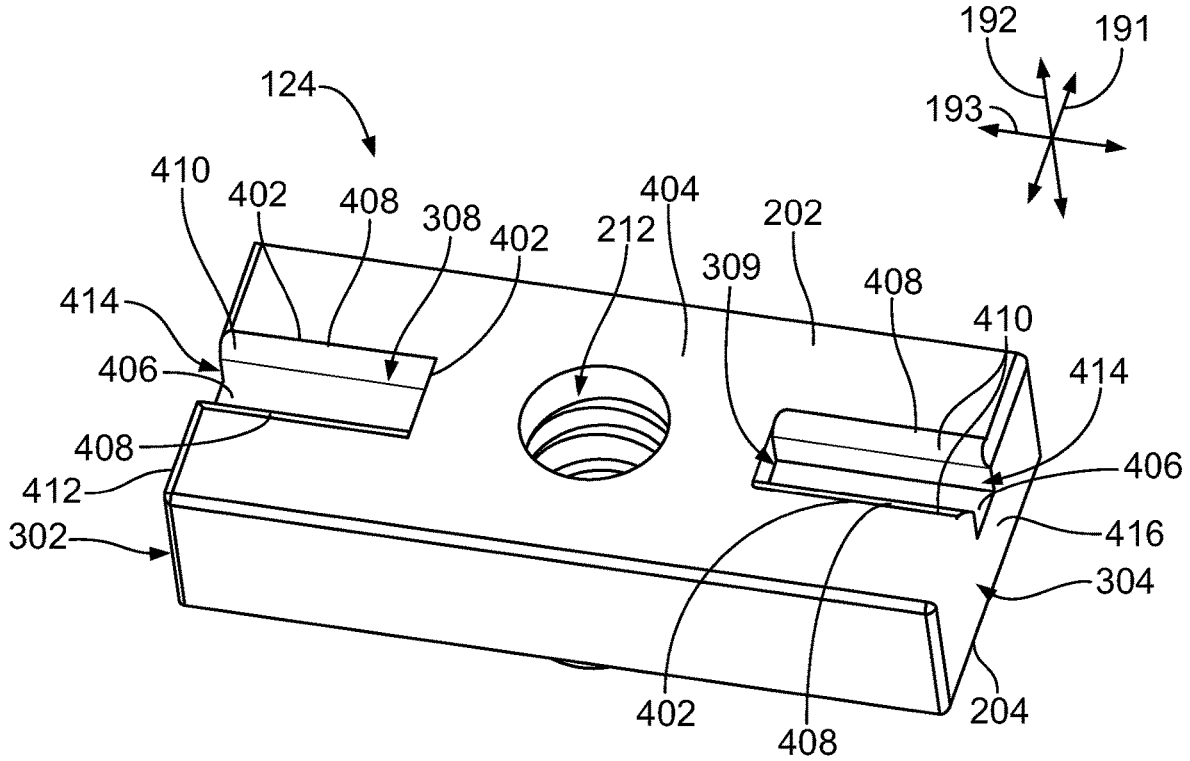
FIG. 4 is a perspective view of the movable contact of the electromechanical switch according to the embodiment shown in FIG. 3.

FIG. 4 is a perspective view of the movable contact 124 of the electromechanical switch 101 according to the embodiment shown in FIG. 3. The opening 212 that receives the shaft 134 is disposed between the first and second depressions 308, 309, and extends fully through the movable contact 124 from the mounting side 204 to the mating side 202. In the illustrated embodiment, the first depression 308 and the second depression 309 are both oblong grooves. The depressions 308, 309 are elongated along the longitudinal axis 193 (e.g., parallel to the length of the movable contact 124 between the first and second ends 302, 304). The depressions 308, 309 are recessed relative to the mating side 202 and inwardly extend towards the mounting side 204.

A perimeter of each depression 308, 309 is defined by a respective edge 402 at the mating side 202. The mating side 202 has a surface 404. The edges 402 of the depressions 308, 309 are at (e.g., coplanar with) the surface 404. The surface 404 is planar in the illustrated embodiment, but may be non-planar in an alternative embodiment. Each of the depressions 308, 309 has a depth (e.g., along the height axis 192) that inwardly extends from the respective edge 402 to a respective nadir 406, which is recessed relative to the surface 404. The nadirs 406 represent deepest (e.g., innermost) portion of the respective depressions 308, 309.

In the illustrated embodiment in which the depressions 308, 309 are oblong grooves, the edge 402 of each of the depressions 308, 309 includes two elongated edge segments 408. The elongated edge segments 408 are parallel to one another and define a lateral width of each of the depressions 308, 309 therebetween. The elongated edge segments 408 are linear in FIG. 4 and extend parallel to the longitudinal axis 193. In an alternative embodiment, the elongated edge segments 408 are neither linear nor parallel, but rather are curved and bulge in opposite directions from one another such that the depressions 308, 309 resemble ovals instead of rectangles when viewing the mating side 202 from above. The elongated edge segments 408 may be tapered to have curved sloping surfaces 410. Each of the curved sloping surfaces 410 curves along both the lateral axis 191 and the height axis 192. Alternatively, the elongated edge segments 408 may have right angle corners instead of the curved sloping surfaces 410.

In the illustrated embodiment, the first depression 308 extends fully to the first end 302 of the movable contact 124, and the second depression 309 extends fully to the second end 304. For example, the edge 402 of the first depression 308 at the surface 404 extends only around three sides of the depression 308, and the fourth side is open at the first end 302. An end wall 412 of the movable contact 124 at the first end 302 defines a cutout area 414 where the first depression 308 intersects the first end 302. A similar cutout area 414 is defined along an end wall 416 of the movable contact 124 at the second end 304 where the second depression 309 intersects the second end 304. The depressions 308, 309 extending to the corresponding ends 302, 304 may provide channels for directing electrical arcs to blow outward away from the contact interfaces when the movable contact 124 initially connects with and/or disconnects from the stationary contacts 108, 109. Providing a path for the arcs away from the engagement interfaces reduces strain and damage to the contacts 108, 109, 124. In an alternative embodiment, at least one of the depressions 308, 309 does not extend fully to the corresponding end 302, 304 of the movable contact 124.

Figure 5:
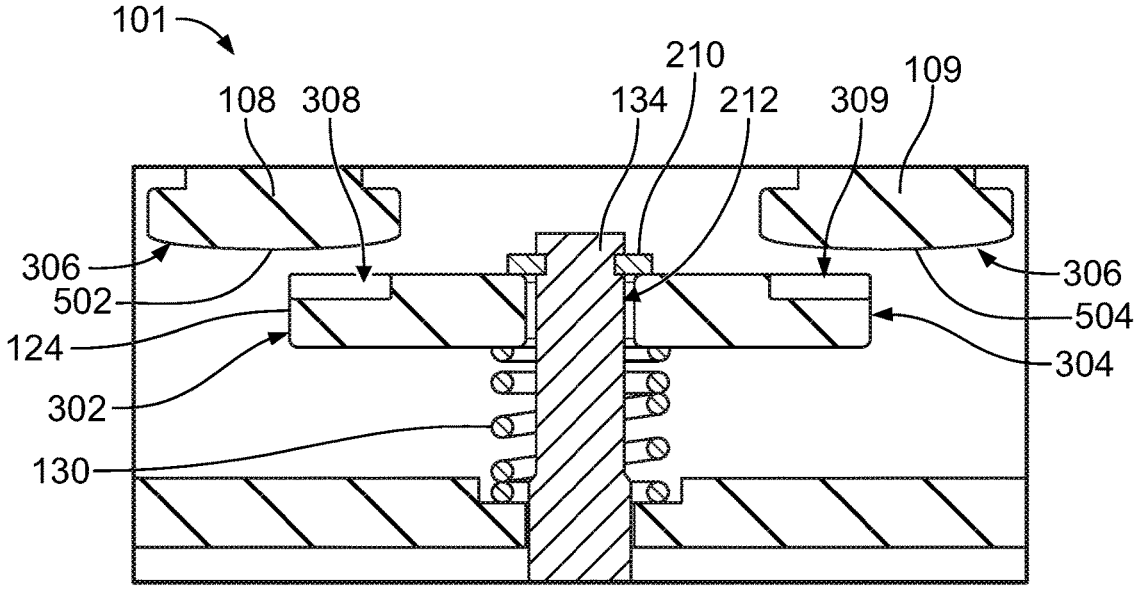
FIG. 5 is a cross-sectional view of the portion of the electromechanical switch shown in FIG. 3.

FIG. 5 is a cross-sectional view of the portion of the electromechanical switch 101 shown in FIG. 3. The cross-section is taken along the line 5-5 in FIG. 3. The shaft 134 protrudes through the opening 212 of the movable contact 124 between the two depressions 308, 309. The contact spring 130 biases the movable contact 124 into sustained engagement with the clip 210. In the illustrated embodiment, the mating end 306 of the first stationary contact 108 has a protrusion 502, and the mating end 306 of the second stationary contact 109 has a protrusion 504. The protrusions 502, 504 bulge downward in the illustrated orientation towards the movable contact 124. For example, a middle of each of the protrusions 502, 504 is disposed closer to the movable contact 124 along the height axis 192 than an outer edge of the protrusion 502, 504. The protrusion 502 of the first stationary contact 108 aligns with the first depression 308, and the protrusion 504 of the second stationary contact 109 aligns with the second depression 309.

In the illustrated embodiment, the first stationary contact 108 laterally projects beyond the first end 302 of the movable contact 124, and the second stationary contact 109 laterally projects beyond the second end 304 of the movable contact 124, which may provide space for electrical arcs to blow outward. But, in an alternative embodiment, the movable contact 124 may be longer such that the stationary contacts 108, 109 do not project beyond the ends 302, 304.

Figure 6:
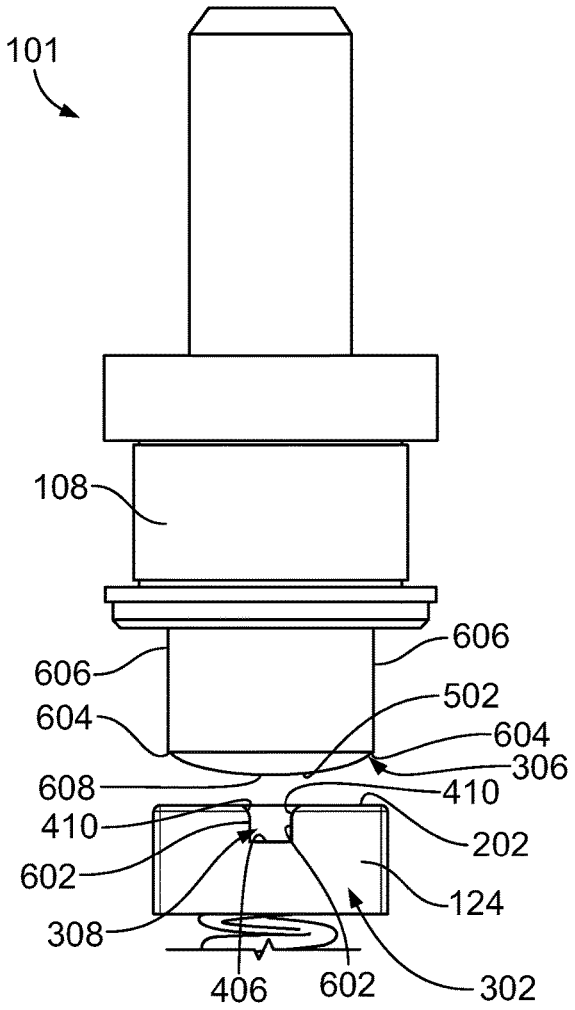
FIG. 6 is an end view of a portion of the electromechanical switch showing a first stationary contact and a first end of the movable contact according to the embodiment shown in FIGS. 3 through 5.

FIG. 6 is an end view of a portion of the electromechanical switch 101 showing the first stationary contact 108 and the first end 302 of the movable contact 124 according to the embodiment shown in FIGS. 3 through 5. The movable contact 124 is in the open position in the illustrated embodiment, such that the mating end 306 of the stationary contact 108 is spaced apart from the mating side 202 of the movable contact 124. Although the description below refers to the first stationary contact 108, the second stationary contact 109 may be identical (or substantially similar in size and shape) to the first stationary contact 108, such that the following description may also apply to the second stationary contact 109. Furthermore, although the following description refers to the first depression 308 of the movable contact 124, the second depression 309 may be identical (or substantially similar in size and shape) to the first depression 308, such that the description may be applicable to the second depression 309.

In the illustrated embodiment, the first depression 308 of the movable contact 124 has a generally polygonal shape, including two side walls 602 that extend between the curved sloping surfaces 410 and the nadir 406. The nadir 406 and the side walls 602 are relatively linear and flat. In an alternative embodiment, the depression 308 may be more curved (e.g., bowl-shaped).

The protrusion 502 at the mating end 306 of the first stationary contact 108 is a rounded bulge in the illustrated embodiment, as described above with reference to FIG. 5. In FIG. 6, the protrusion 502 occupies an entire surface area of the mating end 306. For example, edges 604 of the protrusion 502 are located at a cylindrical outer surface 606 of the stationary contact 108. The middle 608 of the protrusion 502 projects downward beyond the edges 604 towards the movable contact 124.

Figure 7:
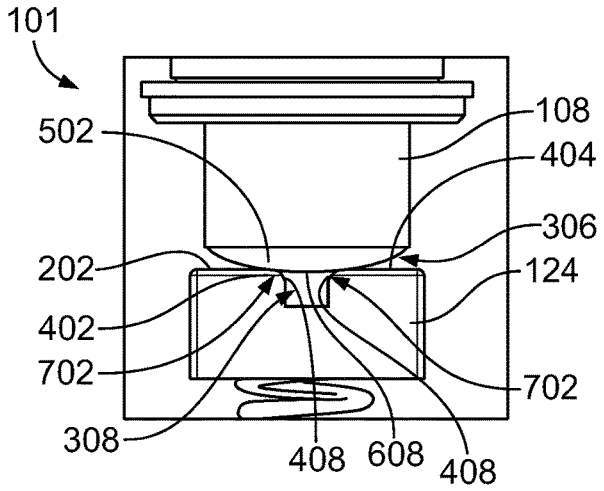
FIG. 7 is an end view of the portion of the electromechanical switch shown in FIG. 6 with the movable contact in the closed position, engaging the first stationary contact.

FIG. 7 is an end view of the portion of the electromechanical switch 101 shown in FIG. 6 with the movable contact 124 in the closed position, engaging the first stationary contact 108. When the movable contact 124 is moved towards the first stationary contact 108 and the second stationary contact 109 (shown in FIG. 3) to the closed position, the mating side 202 of the movable contact 124 engages the mating ends 306 of the stationary contacts 108, 109. As shown in FIG. 7, the protrusion 502 of the first stationary contact 108 projects into the first depression 308 of the movable contact 124. The protrusion 502 engages the edge 402 of the first depression 308 at multiple contact points 702. For example, two contact points 702 are shown in FIG. 7. The contact points 702 are located on the elongated edge segments 408 that define the width of the depression 308. The protrusion 502 engages each of the two elongated edge segments 408 at one or more contact points.

The protrusion 502 extends into the first depression 308 such that the middle 608 of the protrusion 502 projects beyond the surface 404 of the movable contact 124. In the illustrated embodiment, the middle 608 is spaced apart from and does not engage the nadir 406 of the depression 308. Thus, the protrusion 502 does not bottom out in the depression 308. The engagement between the protrusion 502 and the depression 308 may be limited to the edge 402 (e.g., the elongated edge segments 408) of the depression 308.

Although not shown in FIG. 7, the second stationary contact 109 (shown in FIG. 3) engages the second depression 309 of the movable contact 124 in the same way as described above when the movable contact 124 is in the closed position. For example, the protrusion 504 of the second stationary contact 109 projects into the second depression 309 and engages the edge 402 of the second depression 309 at multiple contact points.

The protrusions 502, 504 of the stationary contacts 108, 109 effectively nest within the corresponding depressions 308, 309 of the movable contact 124 in a stable engagement interface. For example, instead of face-to-face abutment as in some known electromechanical switches, the protrusion 502 shown in FIG. 7 achieves a stable, seated configuration in engagement with the elongated edge portions 408. The nested configuration in the illustrated embodiment may be more stable and, therefore, less likely to oscillate and vibrate during surges of current, than known electromechanical switches having face-to-face contact interfaces or the like. As a consequence of improved stability, the electromechanical switch 101 described herein may eliminate or at least reduce the occurrence of an audible noise attributable to oscillations at the contact interfaces.

Figure 8:
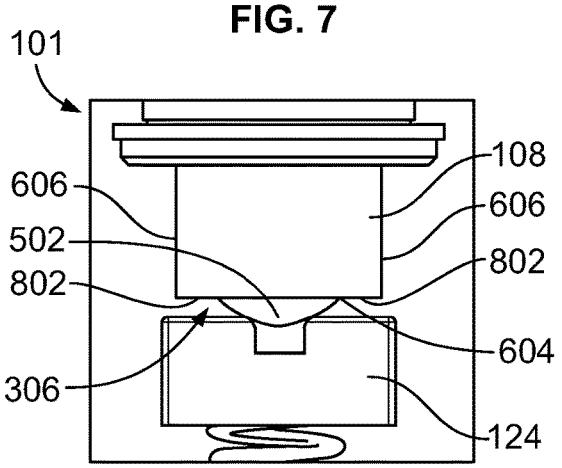
FIG. 8 is an end view of a portion of the electromechanical switch with the movable contact in the closed position according to a first alternative embodiment.

FIG. 8 is an end view of the portion of the electromechanical switch 101 with the movable contact 124 in the closed position as shown in FIG. 7 according to a first alternative embodiment. In FIG. 8, the movable contact 124 is unchanged from the embodiment shown in FIGS. 3 through 7, but the protrusion 502 at the mating end 306 of the first stationary contact 108 is modified. For example, the protrusion 502 in the illustrated embodiment does not occupy or cover the entire area of the mating end 306. For example, a diameter of the protrusion 502 is less than the diameter of the cylindrical portion of the stationary contact 108 that extends to the mating end 306. The stationary contact 108 includes a flat area 802 radially extending inward from the cylindrical outer surface 606 to the protrusion 502 (e.g., the edges 604 thereof). In other embodiments, the protrusion 502 of the first stationary contact 108 and the protrusion 504 of the second stationary contact 109 (shown in FIG. 5) may have different sizes and/or shapes than the embodiments shown in FIGS. 5 through 8.

Figure 9:
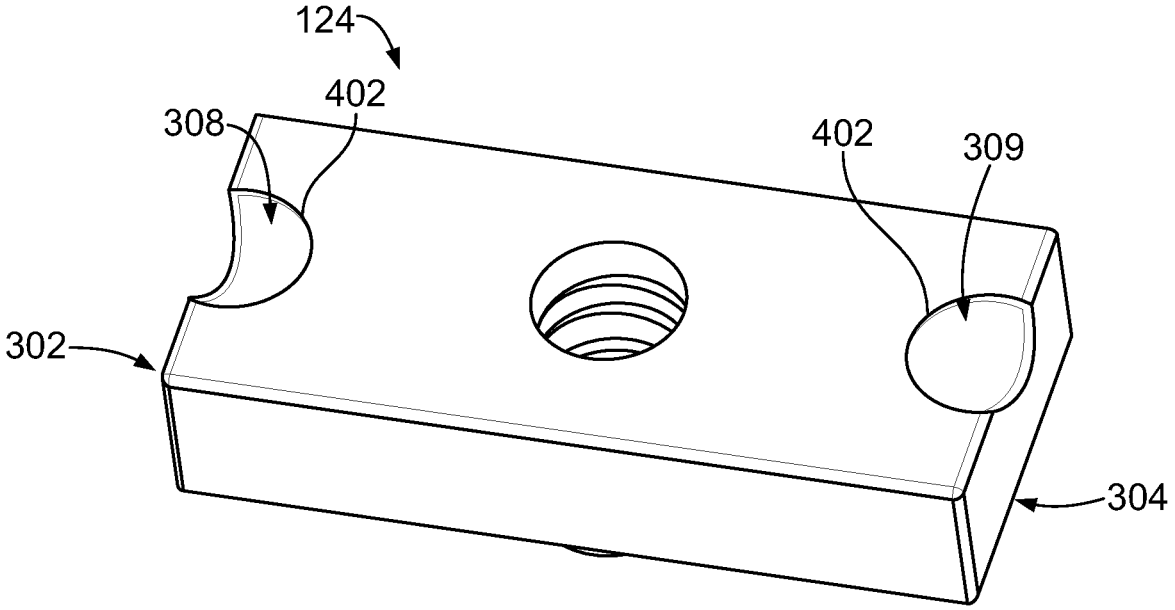
FIG. 9 is a perspective view of the movable contact of the electromechanical switch according to a second alternative embodiment.

FIG. 9 is a perspective view of the movable contact 124 of the electromechanical switch 101 according to a second alternative embodiment. Instead of oblong grooves, the first depression 308 and the second depression 309 of the movable contact 124 in the illustrated embodiment are rounded craters. For example, the edges 402 that define the perimeters of the depressions 308, 309 are circular or partially circular. In the illustrated embodiment, the depressions 308, 309 extend to the corresponding first and second ends 302, 304 of the movable contact 124, and the edges 402 are only partially circular.

Figure 10:
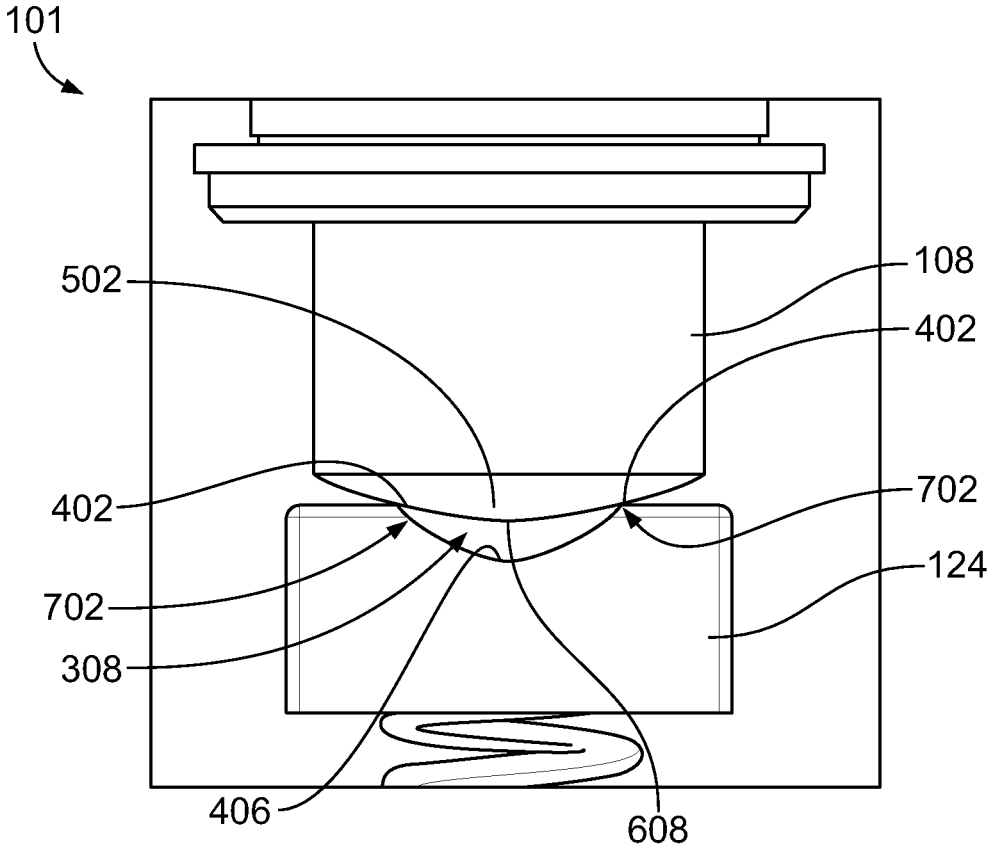
FIG. 10 is an end view of a portion of the electromechanical switch with the movable contact in the closed position engaging the first stationary contact according to the second alternative embodiment shown in FIG. 9.

FIG. 10 is an end view of a portion of the electromechanical switch 101 with the movable contact 124 in the closed position engaging the first stationary contact 108 according to the second alternative embodiment shown in FIG. 9. The protrusion 502 of the first stationary contact 108 is the same as in the embodiment shown in FIGS. 6 and 7. Both the protrusion 502 and the depression 308 are rounded. In the illustrated embodiment, the protrusion 502 of the stationary contact 108 has a greater diameter than the crater of the depression 308. For example, each of the protrusion 502 and the depression 308 in the end view of FIG. 10 may generally represent a respective arc length of a larger circle. The protrusion 502 curves more gradually than the depression 308, and therefore the larger circle associated with the protrusion 502 has a greater diameter than the larger circle associated with the depression 308. As a result, in the closed position, the protrusion 502 engages the edge 402 of the depression 308 at multiple contact points 702 and nests within the depression 308. The middle 608 of the protrusion 502 projects into the depression 308 but does not engage the nadir 406 of the depression 308.

Figure 11:
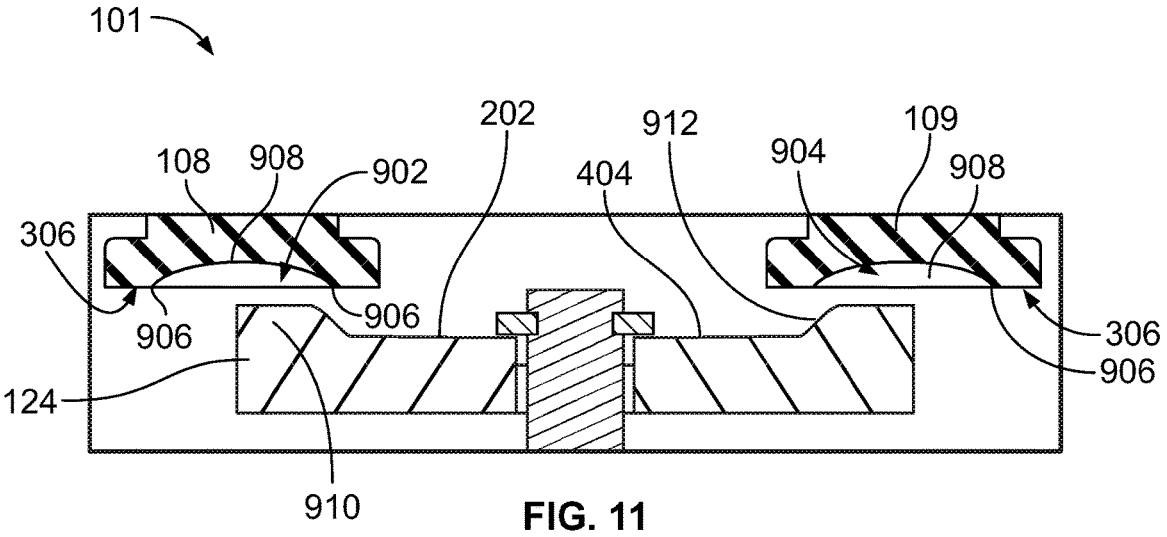
FIG. 11 is a cross-sectional view of the portion of the electromechanical switch along the line 5-5 shown in FIG. 3 according to a third alternative embodiment.
Figure 12:
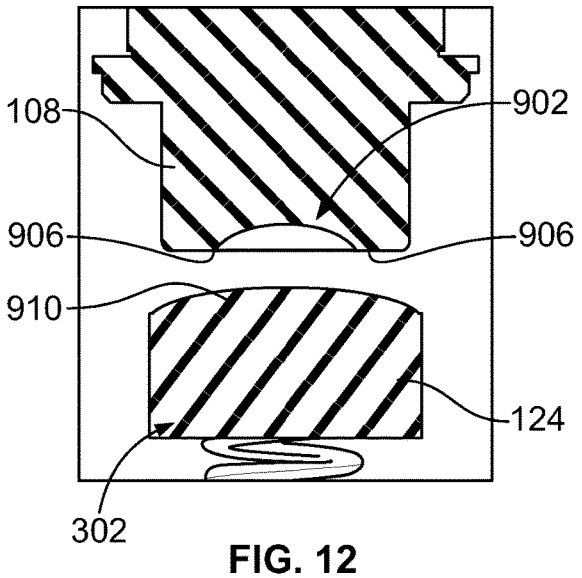
FIG. 12 is a cross-sectional end view showing the first stationary contact and the first end of the movable contact according to the third alternative embodiment shown in FIG. 11.

FIG. 11 is a cross-sectional view of the portion of the electromechanical switch 101 along the line 5-5 shown in FIG. 3 according to a third alternative embodiment. FIG. 12 is a cross-sectional end view showing the first stationary contact 108 and the first end 302 of the movable contact 124 according to the third alternative embodiment shown in FIG. 11. In the illustrated embodiment, the mating end 306 of the first stationary contact 108 defines a depression 902, and the mating end 306 of the second stationary contact 109 defines a depression 904. For example, edges 906 of the depressions 902, 904 are along the mating ends 306, and are closer to the movable contact 124 than respective middles (or nadirs) 908 of the depressions 902, 904.

The movable contact 124 includes a first protrusion 910 and a second protrusion 912 that project beyond the surface 404 of the mating side 202 towards the stationary contacts 108, 109. The first protrusion 910 aligns with the first stationary contact 108. The second protrusion 912 is spaced apart from the first protrusion 910 along the length of the movable contact 124 and aligns with the second stationary contact 109. When the movable contact 124 is moved to the closed position, the first protrusion 910 projects into the depression 902 of the first stationary contact 108 and engages the edge 906 thereof at multiple contact points, and the second protrusion 912 projects into the depression 904 of the second stationary contact 109 and engages the edge 906 thereof at multiple contact points. As shown in FIG. 12, the first protrusion 910 of the movable contact 124 may nest within the depression 902 of the first stationary contact 108 in a similar, but inverted, manner relative to the embodiment shown in FIG. 10. FIGS. 11 and 12 illustrate that the embodiments shown in FIGS. 1 through 10 may be inverted such that the movable contact 124 has protrusions 910, 912 that are received within respective depressions 902, 904 of the stationary contacts 108, 109 to provide stable, nested engagement that prohibits oscillations at the contact interfaces.

Figure 13:
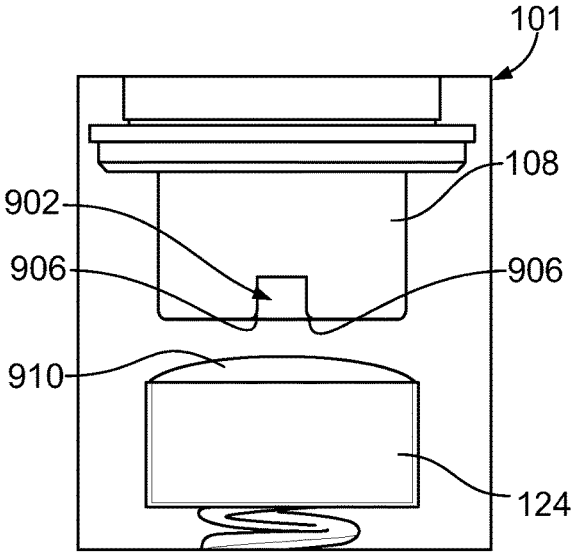
FIG. 13 is an end view of a portion of the electromechanical switch with the movable contact in the open position relative to the first stationary contact according to a fourth alternative embodiment.

FIG. 13 is an end view of a portion of the electromechanical switch 101 with the movable contact 124 in the open position relative to the first stationary contact 108 according to a fourth alternative embodiment. FIG. 13 is similar to the embodiment shown in FIGS. 11 and 12, except that the depression 902 of the first stationary contact 108 is an oblong groove instead of a rounded, bowl-shaped crater. The depression 902 may be similar in size and/or shape to the depressions 308, 309 of the movable contact 124 according to the embodiment shown in FIG. 4. The first protrusion 910 of the movable contact 124 projects into the depression 902 and engages the edge 906 of the depression 902 at multiple contact points when the movable contact 124 is moved to the closed position.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely example embodiments. Many other embodiments and modifications within the spirit and scope of the claims will be apparent to those of ordinary skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electromechanical switch comprising:

first and second stationary contacts spaced apart from each other, each of the first and second stationary contacts having a respective protrusion at a mating end thereof;

a movable contact having a mating side and defining a first depression and a second depression along the mating side, each of the first and second depressions inwardly extending from a respective edge at the mating side; and an armature assembly including a shaft coupled to the movable contact and a ferromagnetic plunger coupled to the shaft, wherein the armature assembly reciprocally moves the movable contact into and out of a closed position relative to the first and second stationary contacts based on a magnetic field induced by current through a coil of wire surrounding the ferromagnetic plunger, wherein, in the closed position, the protrusion of the first stationary contact projects into the first depression and engages the edge of the first depression at multiple contact points, and the protrusion of the second stationary contact projects into the second depression and engages the edge of the second depression at multiple contact points, wherein the movable contact defines an opening that is disposed between the first and second depressions along a length of the movable contact, and the shaft is received in the opening.

2. The electromechanical switch of claim 1, wherein each of the first and second depressions inwardly extends from the respective edge thereof to a respective nadir that is recessed relative to the edge, wherein, in the closed position, the protrusions of the first and second stationary contacts engage the edges of the corresponding first and second depressions without engaging the nadirs.

3. The electromechanical switch of claim 1, wherein each of the first depression and the second depression is an oblong groove including two elongated edge segments, wherein, in the closed position, the protrusion of the first stationary contact engages both of the elongated edge segments of the first depression and the protrusion of the second stationary contact engages both of the elongated edge segments of the second depression.

4. The electromechanical switch of claim 1, wherein each of the first depression and the second depression is a rounded crater.

5. The electromechanical switch of claim 1, wherein a length of the movable contact extends from a first end thereof to a second end thereof, wherein the first depression extends to the first end and the second depression extends to the second end.

* * * * *